US008043167B2

(12) United States Patent
Boyd et al.

(10) Patent No.: US 8,043,167 B2
(45) Date of Patent: Oct. 25, 2011

(54) GOLF CLUBS AND GOLF CLUB HEADS HAVING INTERCHANGEABLE REAR BODY MEMBERS

(75) Inventors: Robert Boyd, Euless, TX (US); John T. Stites, Weatherford, TX (US); Gary G. Tavares, Azle, TX (US)

(73) Assignee: Nike, Inc., Beaverton, OR (US)

( * ) Notice: Subject to any disclaimer, the term of this patent is extended or adjusted under 35 U.S.C. 154(b) by 124 days.

(21) Appl. No.: 12/338,487

(22) Filed: Dec. 18, 2008

(65) Prior Publication Data

US 2010/0160091 A1 Jun. 24, 2010

(51) Int. Cl.
*A63B 53/04* (2006.01)
*A63B 53/06* (2006.01)

(52) U.S. Cl. ..... 473/334; 473/345

(58) Field of Classification Search ..... 473/324–350
See application file for complete search history.

(56) References Cited

U.S. PATENT DOCUMENTS

| | | | | | |
|---|---|---|---|---|---|
| 1,167,106 | A | * | 1/1916 | Palmer | 473/337 |
| 1,538,312 | A | * | 5/1925 | Beat | 473/337 |
| 1,840,924 | A | * | 1/1932 | Tucker | 473/337 |
| 3,064,980 | A | * | 11/1962 | Steiner | 473/335 |
| 3,220,733 | A | * | 11/1965 | Saleeby | 473/335 |
| 3,637,218 | A | * | 1/1972 | Carlino | 473/325 |
| 3,817,534 | A | * | 6/1974 | Carlino | 473/337 |
| 3,979,123 | A | * | 9/1976 | Belmont | 473/337 |
| 4,811,949 | A | * | 3/1989 | Kobayashi | 473/337 |
| 4,883,274 | A | * | 11/1989 | Hsien | 473/335 |
| 5,230,509 | A | * | 7/1993 | Chavez | 473/336 |
| 5,421,577 | A | * | 6/1995 | Kobayashi | 473/335 |
| 5,518,243 | A | * | 5/1996 | Redman | 473/334 |
| 5,584,770 | A | * | 12/1996 | Jensen | 473/350 |
| 5,720,674 | A | | 2/1998 | Galy | |
| 5,971,867 | A | | 10/1999 | Galy | |
| 6,030,293 | A | * | 2/2000 | Takeda | 473/334 |
| 6,217,461 | B1 | | 4/2001 | Galy | |
| 6,290,608 | B2 | * | 9/2001 | Gates | 473/292 |
| 6,440,009 | B1 | * | 8/2002 | Guibaud et al. | 473/334 |
| 6,458,044 | B1 | * | 10/2002 | Vincent et al. | 473/334 |
| 6,641,487 | B1 | * | 11/2003 | Hamburger | 473/288 |
| 6,648,772 | B2 | * | 11/2003 | Vincent et al. | 473/334 |

(Continued)

FOREIGN PATENT DOCUMENTS

| | | | |
|---|---|---|---|
| JP | 01043278 | | 2/1989 |
| JP | 02084972 | A * | 3/1990 |
| JP | 05049715 | A * | 3/1993 |
| JP | 07231957 | A * | 9/1995 |
| JP | 08322970 | | 12/1996 |
| JP | 10263116 | A * | 10/1998 |

(Continued)

OTHER PUBLICATIONS

PCT/US2009/067430, International Search Report and Written Opinion, dated Nov. 24, 2010.

*Primary Examiner* — Alvin Hunter
(74) *Attorney, Agent, or Firm* — Banner & Witcoff, Ltd.

(57) ABSTRACT

Golf club heads (e.g., drivers, fairway woods, wood-type hybrid clubs, or the like) according to at least some example aspects of this invention include: (a) a heel; (b) a toe; (c) a crown; (d) a sole; (e) a striking face; (f) a cavity, wherein the cavity is at least partially open; (g) a rear face opposite the striking face, the rear face defining an opening to the cavity; and (h) a rear body member configured to be inserted into the opening. The rear body member may be releasably engaged with the opening to the cavity, rear face, and/or other portion of the club head body.

19 Claims, 6 Drawing Sheets

U.S. PATENT DOCUMENTS

| | | | | |
|---|---|---|---|---|
| 6,739,983 | B2 * | 5/2004 | Helmstetter et al. | 473/342 |
| D502,235 | S * | 2/2005 | Burrows | D21/742 |
| 6,860,818 | B2 | 3/2005 | Mahaffey et al. | |
| 6,890,267 | B2 | 5/2005 | Mahaffey et al. | |
| 6,988,960 | B2 | 1/2006 | Mahaffey et al. | |
| 7,083,530 | B2 * | 8/2006 | Wahl et al. | 473/334 |
| 7,108,611 | B2 * | 9/2006 | MacIlraith | 473/288 |
| 7,147,573 | B2 * | 12/2006 | DiMarco | 473/324 |
| 7,153,220 | B2 * | 12/2006 | Lo | 473/335 |
| 7,163,468 | B2 * | 1/2007 | Gibbs et al. | 473/329 |
| 7,166,041 | B2 * | 1/2007 | Evans | 473/334 |
| 7,396,299 | B2 * | 7/2008 | Nicolette et al. | 473/350 |
| 7,491,131 | B2 * | 2/2009 | Vinton | 473/251 |
| 7,549,935 | B2 * | 6/2009 | Foster et al. | 473/335 |
| 7,628,711 | B2 * | 12/2009 | Akinori et al. | 473/335 |
| 7,637,822 | B2 * | 12/2009 | Foster et al. | 473/329 |
| 7,713,143 | B2 * | 5/2010 | Evans | 473/334 |
| 2004/0132541 | A1 | 7/2004 | MacIlraith | |
| 2008/0039228 | A1 | 2/2008 | Breier et al. | |

FOREIGN PATENT DOCUMENTS

| | | | |
|---|---|---|---|
| JP | 11244433 | A * | 9/1999 |
| JP | 2000014841 | A * | 1/2000 |
| JP | 2001000606 | A * | 1/2001 |
| JP | 2001025518 | A * | 1/2001 |
| JP | 2001062013 | A * | 3/2001 |
| JP | 2001321474 | A * | 11/2001 |
| JP | 2003062133 | A * | 3/2003 |
| JP | 2003169870 | A * | 6/2003 |
| JP | 2004081241 | A * | 3/2004 |
| JP | 2004337608 | A * | 12/2004 |
| JP | 2006239154 | A * | 9/2006 |
| JP | 2006288882 | A * | 10/2006 |
| JP | 2007083012 | A * | 4/2007 |
| WO | 9532765 | | 12/1995 |
| WO | 9922824 | | 5/1999 |
| WO | 2009102661 | | 8/2009 |
| WO | 2009102693 | | 8/2009 |

* cited by examiner

GOLF CLUBS AND GOLF CLUB HEADS HAVING INTERCHANGEABLE REAR BODY MEMBERS

FIELD OF THE INVENTION

The present invention relates generally to golf clubs and golf club heads. Particular example aspects of this invention relate to golf clubs and golf club heads having interchangeable rear body members.

BACKGROUND

In recent years, golf club heads and golf clubs have been designed to improve a golfer's accuracy by assisting the golfer in squaring the club head face at impact with a golf ball. A number of golf club heads have at least some weight of the golf club head positioned so as to alter or control the location of the club head's center of gravity. The location of the center of gravity of the golf club head is one factor that determines whether a golf ball will be propelled in the intended direction. When the center of gravity is positioned behind the point of engagement on the contact surface, the golf ball follows a generally straight route. When the center of gravity is spaced to a side of the point of engagement, however, the golf ball may fly in an unintended direction and/or may follow a route that curves left or right, ball flights that often are referred to as "pulls," "pushes," "draws," "fades," "hooks," or "slices." Similarly, when the center of gravity is spaced above or below the point of engagement, the flight of the golf ball may exhibit more boring or climbing trajectories, respectively.

While the industry has witnessed dramatic changes and improvements to golf equipment in recent years, some players continue to experience difficulties in reliably hitting a golf ball in an intended and desired direction and/or with an intended and desired flight path. This is particularly true for clubs used to hit the ball long distances, such as drivers and woods. Accordingly, there is room in the art for further advances in golf club technology.

SUMMARY OF THE INVENTION

Golf club heads, and particularly wood-type golf club heads (e.g., drivers, fairway woods, wood-type hybrid clubs, or the like), according to at least some example aspects of this invention include: (a) a club head body made from one or more parts, wherein the club head body includes a heel portion, a toe portion, a top portion, a sole portion, a striking face, and a rear portion opposite the striking face, wherein the club head body defines an interior cavity, and wherein the rear portion defines at least a first opening to the interior cavity; and (b) a rear body made from one or more parts, wherein the rear body is releasably engaged with the club head body and is configured to at least partially cover the first opening. The rear body member may be releasably engaged with the rear face and/or other portion of the club head body.

Additional aspects of this invention relate to golf club structures that include golf club heads, e.g., of the types described above. Such golf club structures further may include one or more of: a shaft member attached to the club head (optionally via a separate hosel member or a hosel member provided as an integral part of one or more of the club head or shaft); a grip or handle member attached to the shaft member; additional weight members; etc.

Still additional aspects of this invention relate to methods for making golf club heads and golf club structures in accordance with examples of this invention. Such methods may include, for example: (a) providing a golf club head or club head body of the various types described above, e.g., by manufacturing or otherwise making the golf club head, by obtaining the golf club head from another source, etc.; (b) engaging a shaft member with the golf club head; (c) engaging a grip member with the shaft member; (d) engaging a weight member with the golf club head; and/or (e) engaging a rear body member with the rear portion and/or other portion of the club head body or club structure; etc.

BRIEF DESCRIPTION OF THE DRAWINGS

The present invention is illustrated by way of example and not limited in the accompanying figures, in which like reference numerals indicate similar elements throughout, and in which.

Figure 1A:
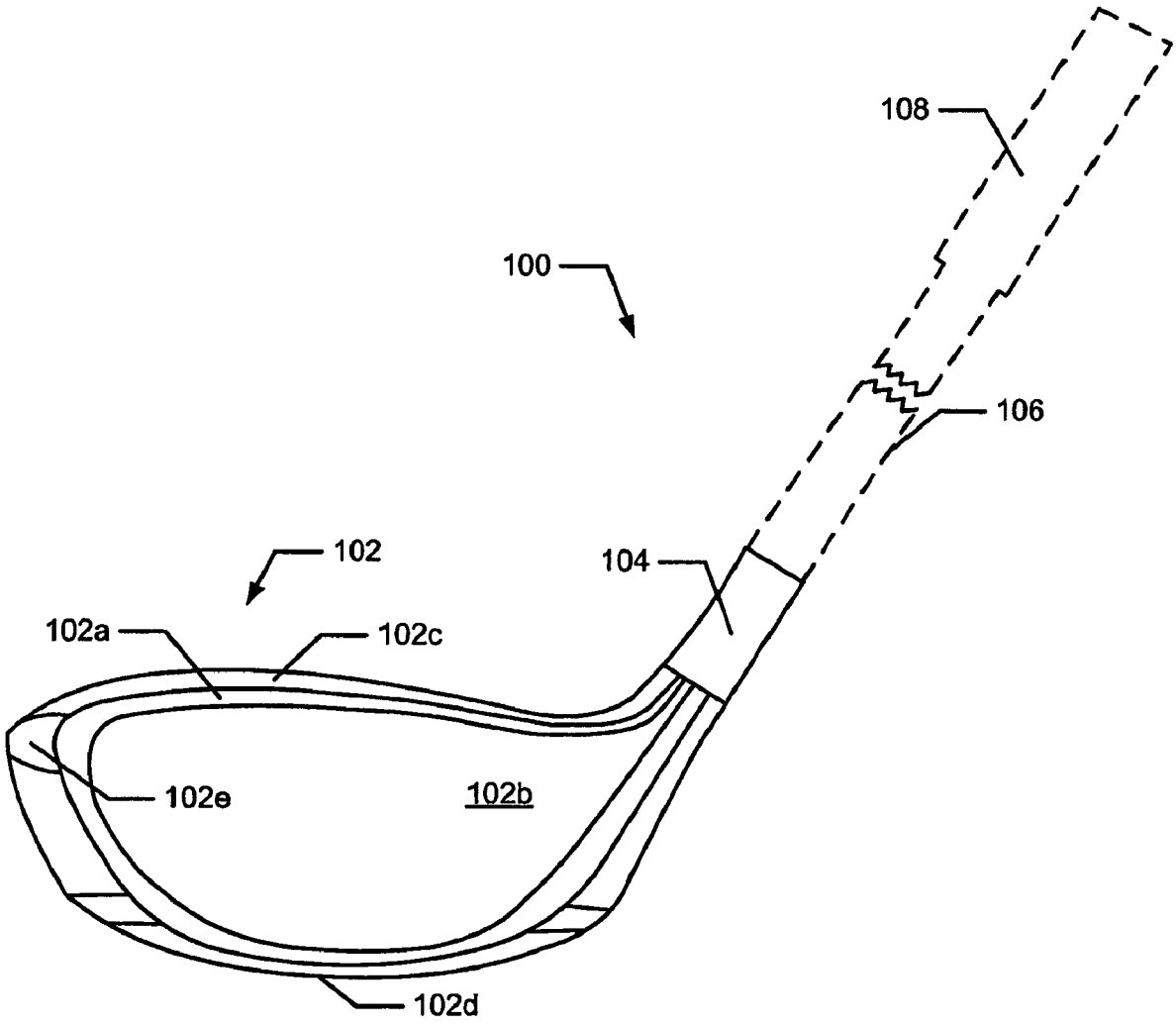
FIGS. 1A and 1B generally illustrate features of club head structures according to at least some examples of this invention.

The reader is advised that the various parts shown in these drawings are not necessarily drawn to scale.

DETAILED DESCRIPTION

The following description and the accompanying figures disclose features of golf club heads and golf clubs in accordance with examples of the present invention.

I. GENERAL DESCRIPTION OF EXAMPLE GOLF CLUB HEADS, GOLF CLUBS, AND METHODS IN ACCORDANCE WITH THIS INVENTION

Aspects of this invention relate to golf club heads and golf clubs including club heads (e.g., drivers, fairway woods, wood-type hybrid clubs, or the like). Golf club heads according to at least some aspects of this invention may include: (a) a club head body made from one or more parts, wherein the club head body includes a heel portion, a toe portion, a top portion, a sole portion, a striking face, and a rear portion opposite the striking face, wherein the club head body defines an interior cavity, and wherein the rear portion defines at least a first opening to the interior cavity; and (b) a rear body made from one or more parts, wherein the rear body is releasably engaged with the club head body and is configured to at least partially cover the first opening. The rear body may be releasably engaged with the club head body (e.g., the rear portion and/or other portion(s) of the club head body). Any desired portion of the rear body member may be engaged with the club head body. In some embodiments, a portion of the rear body may extend into a cavity defined in the club head body (e.g., at least some portion, all, or at least a major portion of the rear body member may be located within the rear body member receiving cavity). In other embodiments, at least a portion of the rear body may extend beyond the exterior perimeter surface of the rear portion of the club head body. Additionally, if desired, the rear body may form at least a portion of the golf club head's crown and or sole when attached to the main club head body. Alternatively, in some embodiments, the rear body will not form any portion of the crown and or sole. Using different releasably engageable rear bodies may allow for the modification of the overall size, shape, weight, weight distribution, center of gravity, moment of inertia and/or other characteristics of the golf club head. In certain aspects of the invention, the rear body may provide an overall conventionally shaped golf club head (e.g., having a rounded rear perimeter portion) while, in other embodiments, the rear body may provide a more modern club head appearance (e.g., having rear and/or side portions that provide a more square or rectangular overall club head shape).

The rear body receiving cavity, when present, may be provided at any desired location(s) in the rear portion of the club head body without departing from this invention. In some examples, the opening to this rear body receiving cavity may extend beyond the rear portion to the sole and/or the crown of the club head body. Additionally or alternatively, the rear body receiving cavity may extend beyond the rear portion of the club head body to the heel and/or toe portions of the club head body. In some embodiments, the rear body receiving cavity may have a depth of at least 5 millimeters, at least 7 millimeters, or at least 10 millimeters at its deepest location. Additionally, the cross-section of the cavity may be of many shapes including, in some embodiments, cross-sections that are square, rectangular, hemispherical, trapezoidal, etc. One or more rear body receiving cavities and/or one or more rear bodies may be provided in an overall golf club head structure without departing from this invention.

The club head body also may include one or more openings to its interior cavity. In embodiments of the invention with multiple openings, the multiple openings may be substantially adjacent to each other or they may be separated by solid portions of the rear portion of the club head body. In certain aspects of the invention, the golf club head may include multiple rear body members or a rear body member comprised of multiple portions. In some embodiments, the golf club head may include at least two rear body members or at least three body members. The opening(s) to the interior cavity may be located and/or arranged anywhere along the rear portion of the club head body without departing from this invention.

The club head body also may take on a variety of forms without departing from this invention. For example, the club head body may be made from any desired number of different parts, of any desired construction, from any desired materials, etc., without departing from this invention, including from conventional parts, of conventional constructions, and/or from conventional materials as are known and used in the art. In some example structures, the club head body will include one or more of the following parts: a crown, a sole, a face member (optionally including a ball striking face integrally formed therein or attached thereto), one or more body members (e.g., forming or defining the periphery of the club head between the crown and sole), a sole plate, a frame member (optionally of metal, such as titanium alloys or the like, e.g., forming or defining the periphery of the club head between the crown and sole and/or to which one or more of the crown and/or the sole (if present) are engaged, etc.), an aft body, etc. The club head body may include: one or more metal or metal alloy parts (e.g., a frame, optionally including or engaged with the ball striking face, a face member, etc.), such as stainless steel, titanium or titanium alloys, aluminum or aluminum alloys, magnesium or magnesium alloys, etc.; polymeric materials (e.g., for the crown or sole, for the club head body portions between the crown and sole, for the face member, etc.); composite materials, including fiber or particle reinforced composite materials, such as carbon fiber composite materials, basalt fiber composite materials, fiberglass materials, etc. (e.g., for the crown or sole, for the club head body portions between the crown and sole, for the face member, etc.). Any desired structure and/or arrangement of the club head body structure and/or its various parts may be used without departing from this invention.

Also, any desired construction for the rear body may be used without departing from the invention. If desired, the rear body may be releasably engaged with the rear portion and/or other portion of the golf club head in any desired manner without departing from this invention, including through the use of mechanical connectors, retaining member structures, spring-loaded connectors and/or retaining structures, and the like. More specific examples of rear body members and their engagement with the remainder of a club head body are described below.

Additional aspects of this invention relate to golf club structures that include golf club heads, e.g., of the types described above. Such golf club structures further may include one or more of: a shaft member attached to the club head (optionally via a separate hosel member or a hosel member provided as a part of one or more of the club head and/or shaft); a grip or handle member attached to the shaft member; an additional weight member attached to one or more of the club head body, shaft, or grip; multiple rear body members; etc.

Still additional aspects of this invention relate to methods for making golf club heads and golf club structures in accordance with examples of this invention. Such methods may include, for example: (a) providing a golf club head of the various types described above (including any or all of the various structures, features, and/or arrangements described above), e.g., by manufacturing or otherwise making the golf club head, by obtaining it from a third party source, etc.; (b) engaging a shaft member with the golf club head; (c) engaging a grip member with the shaft member; (d) engaging different rear bodies or rear body members with the club head body; etc.

Additional aspects of this invention relate to methods of using golf club heads, e.g., of the various types described above. Such methods may include, for example, securing the rear body member at various positions along the club head body, e.g., the rear portion, the toe portion, the heel portion, etc.; removing the rear body from the club head body; placing a new rear body (or a new portion thereof) on the club head body; etc. In this manner, golf clubs and golf club heads in accordance with examples of this invention may be customized, e.g., to better fit or conform to a specific user's swing characteristics, to help correct or compensate for various swing flaws (e.g., to correct hooks, slices, etc.), to bias a club for specific types of ball flights (e.g., a draw bias, a fade bias, a low flight bias, a high flight bias, etc.), and the like. Golf club heads and/or golf clubs according to the invention also may be used by club fitters to find desired or optimal weighting characteristics for specific users, and if desired, such characteristics may be used in selecting parts, arranging weights, and/or weighting for a final, permanently weighted club structure.

Given the general description of various example aspects of the invention provided above, more detailed descriptions of various specific examples of golf clubs and golf club head structures according to the invention are provided below.

II. DETAILED DESCRIPTION OF EXAMPLE GOLF CLUB HEADS, GOLF CLUB STRUCTURES, AND METHODS ACCORDING TO THE INVENTION

The following discussion and accompanying figures describe various example golf clubs and golf club head structures in accordance with the present invention. When the same reference number appears in more than one drawing, that reference number is used consistently in this specification and the drawings to refer to the same or similar parts throughout.

Example golf club and golf club head structures in accordance with this invention may constitute "wood-type" golf clubs and golf club heads, e.g., clubs and club heads typically used for drivers and fairway woods, as well as for "wood-type" utility or hybrid clubs, or the like. Such club head structures may have little or no actual "wood" material and still may be referred to conventionally in the art as "woods" (e.g., "metal woods," "fairway woods," etc.). The club heads may include a multiple piece construction and structure, e.g., including one or more of a sole member, a face member (optionally including a ball striking face integrally formed therein or attached thereto), one or more body members (e.g., material extending around the perimeter and making up the club head body), a crown member, a face plate, a face frame member (to which a ball striking face may be attached), an aft body, etc. Of course, if desired, various portions of the club head structure may be integrally formed with one another, as a unitary, one piece construction, without departing from the invention (e.g., the body member(s) may be integrally formed with the sole and/or crown members, the face member may be integrally formed with the sole, body, and/or crown members, etc.). Optionally, if desired, the various portions of the club head structure (such as the sole member, the crown member, the face member, the body member(s), etc.) individually may be formed from multiple pieces of material without departing from this invention (e.g., a multi-piece crown, a multi-piece sole, etc.). Also, as other alternatives, if desired, the entire club head may be made as a single, one piece, unitary construction, or a face plate member may be attached to a one piece club head aft body (optionally, a hollow body, etc.). More specific examples and features of golf club heads and golf club structures according to this invention will be described in detail below in conjunction with the example golf club structures illustrated in FIGS. 1 through 3.

Figure 1B:
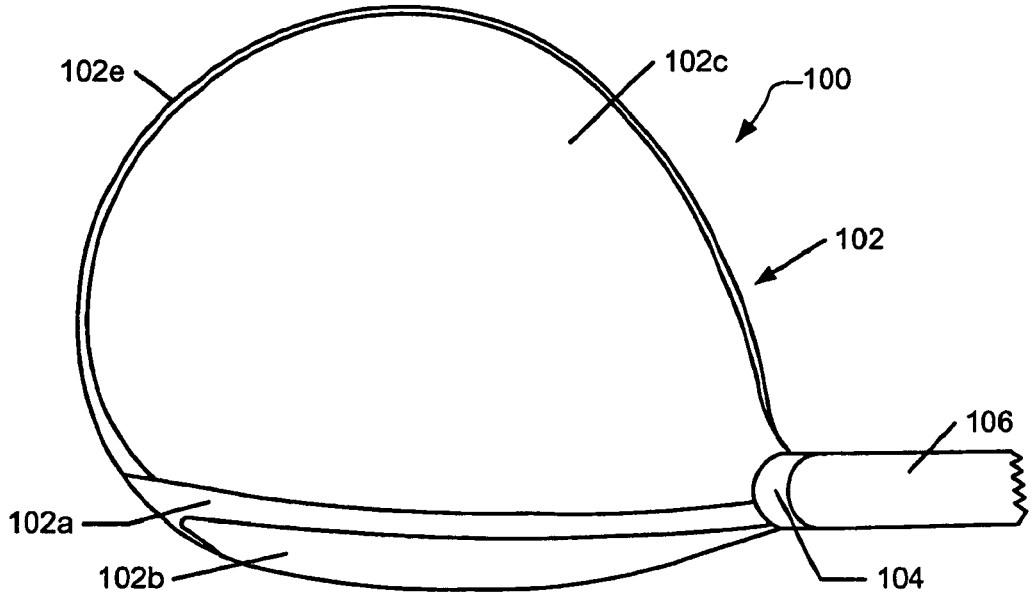

FIGS. 1A and 1B generally illustrate an example golf club 100 and/or golf club head 102 in accordance with this invention. In addition to the golf club head 102, the overall golf club structure 100 of this example includes a hosel region 104, a shaft member 106 received in and/or inserted into and/or through the hosel region 104, and a grip or handle member 108 attached to the shaft member 106. Optionally, if desired, the external hosel region 104 may be eliminated and the shaft member 106 may be directly inserted into and/or otherwise attached to the head member 102 (e.g., through an opening provided in the top of the club head 102, through an internal hosel member (e.g., provided within an interior chamber defined by the club head 102), etc.).

The shaft member 106 may be received in, engaged with, and/or attached to the club head 102 in any suitable or desired manner, including in conventional manners known and used in the art, without departing from the invention. As more specific examples, the shaft member 106 may be engaged with the club head 102 via a hosel member 104 and/or directly to the club head structure 102, e.g., via adhesives, cements, welding, soldering, mechanical connectors (such as threads, retaining elements, or the like), etc.; through a shaft-receiving sleeve or element extending into the club head body 102; etc. The shaft member 106 also may be made from any suitable or desired materials, including conventional materials known and used in the art, such as graphite based materials, composite or other non-metal materials, steel materials (including stainless steel), aluminum materials, other metal alloy materials, polymeric materials, combinations of various materials, and the like. Also, the grip or handle member 108 may be attached to, engaged with, and/or extend from the shaft member 106 in any suitable or desired manner, including in conventional manners known and used in the art, e.g., using adhesives or cements; via welding, soldering, adhesives, or the like; via mechanical connectors (such as threads, retaining elements, etc.); etc. As another example, if desired, the grip or handle member 108 may be integrally formed as a unitary, one-piece construction with the shaft member 106. Additionally, any desired grip or handle member 108 materials may be used without departing from this invention, including, for example: rubber materials, leather materials, rubber or other materials including cord or other fabric material embedded therein, polymeric materials, and the like.

The club head 102 itself also may be constructed in any suitable or desired manner and/or from any suitable or desired materials without departing from this invention, including from conventional materials and/or in conventional manners known and used in the art. For example, in the example structure 102 shown in FIGS. 1A and 1B, the club head 102 includes a ball striking face member 102*a* (optionally including a ball striking face plate 102*b* integrally formed with the face member 102*a* or attached to club such that the face plate 102*b* and a frame member together constitute the overall face member 102*a*). The club head 102 of this illustrated example further includes a crown 102*c*, a sole 102*d*, and at least one body portion 102*e* located between the crown or top portion 102*c* and the sole 102*d* (e.g., material extending from the face member 102*a*, around the club head periphery from the heel to the toe). This body portion 102*e*, which extends to a location substantially opposite the striking face, may include a rear portion of the club head structure.

A wide variety of overall club head constructions are possible without departing from this invention. For example, if desired, some or all of the various individual parts of the club head 102 described above may be made from multiple pieces that are connected together (e.g., by welding, adhesives, or other fusing techniques; by mechanical connectors; etc.). The various parts (e.g., crown 102*c*, sole 102*d*, and/or body portion(s) 102*e*) may be made from any desired materials and combinations of different materials, including materials that are conventionally known and used in the art, such as metal materials, including lightweight metal materials. More specific examples of suitable lightweight metal materials include steel, titanium and titanium alloys, aluminum and aluminum alloys, magnesium and magnesium alloys, etc.

As additional examples or alternatives, in order to reduce the club head 102 weight, if desired, one or more portions of the club head structure 102 advantageously may be made from a composite material, such as from carbon fiber composite materials that are conventionally known and used in the art. Other suitable composite or other non-metal materials that may be used for one or more portions of the club head structure 102 include, for example: fiberglass composite materials, basalt fiber composite materials, polymer materials, etc. As some more specific examples, if desired, at least some portion(s) of the crown member 102*c* may be made from composite or other non-metal materials. Additionally or alternatively, if desired, at least some portion(s) of the sole member 102*d* may be made from composite or other non-metal materials. As still additional examples or alternatives, if desired, one or more portions of the club head's body member 102*e* (the region of material extending between the crown 102*c* and the sole 102*d*) may be made from composite or other non-metal materials. As yet further examples, if desired, the entire body portion of the club head aft of a club head face member 102*a* (also called an "aft body"), or optionally the entire club head, may be made from composite or other non-metal materials without departing from this invention. The composite or other non-metal material(s) may be incorporated as part of the club head structure 102 in any desired manner, including in conventional manners that are known and used in the art. Reducing the club head's weight (e.g., through the use of composite or other non-metal materials, lightweight metals, metallic foam or other cellular structured materials, etc.) allows club designers and/or club fitters to selectively position additional weight in the overall club head structure 102, e.g., to desirable locations to increase the moment of inertia, affect the center of gravity location, and/or affect other playability characteristics of the club head structure 102 (e.g., to draw or fade bias a club head; to help get shots airborne by providing a low center of gravity; to help produce a lower, more boring ball flight; to help correct or compensate for swing flaws that produce undesired ball flights, such as hooks or slices, ballooning shots, etc.; etc.).

The various individual parts that make up a club head structure 102, if made from multiple pieces, may be engaged with one another and/or held together in any suitable or desired manner, including in conventional manners known and used in the art. For example, the various parts of the club head structure 102, such as the face member 102*a*, the ball striking plate 102*b*, the crown 102*c*, the sole 102*d*, and/or the body portion(s) 102*e* may be joined and/or fixed together (directly or indirectly through intermediate members) by adhesives, cements, welding, soldering, or other bonding or finishing techniques; by mechanical connectors (such as threads, screws, nuts, bolts, or other connectors); and the like. If desired, the mating edges of various parts of the club head structure 102 (e.g., the edges where members 102*a*, 102*b*, 102*c*, 102*d*, and/or 102*e* contact and join to one another) may include one or more raised ribs, tabs, ledges, or other engagement elements that fit into or onto corresponding grooves, slots, surfaces, ledges, openings, or other structures provided in or on the facing side edge to which it is joined. Cements, adhesives, mechanical connectors, finishing material, or the like may be used in combination with the raised rib/groove/ledge/edge or other connecting structures described above to further help secure the various parts of the club head structure 102 together.

The dimensions and/or other characteristics of a golf club head structure according to examples of this invention may vary significantly without departing from the invention.

As some more specific examples, club heads in accordance with at least some examples of this invention may have dimensions and/or other characteristics that fall within the various example ranges of dimensions and/or characteristics of the club heads described in U.S. patent application Ser. No. 11/125,327 filed May 10, 2005 (and corresponding to U.S. Published Patent Appln. No. 2005-0239576 A1 published Oct. 27, 2005). Note, for example, the Tables in these documents. This U.S. patent publication is entirely incorporated herein by reference. In accordance with at least some example club head structures according to this invention, the ratio of the breadth dimension (i.e., overall dimension "B" in the front to back direction) to length dimension (i.e., overall dimension "L" from in the heel to toe direction) (i.e., ratio "B/L") will be at least 0.9, and in some examples, this ratio may be at least 0.92, at least 0.93, at least 0.94, at least 0.95, at least 0.96, at least 0.97, or even at least 0.98. The length dimension L may be at least 4 inches, and in some examples, at least 4.25 inches, at least 4.5 inches, at least 4.75 inches, or even at least 4.85 inches. The club head may have any desired volume, including, for example, a volume of at least 200 cc, and in some examples at least 350 cc, at least 400 cc, at least 420 cc, or even at least 450 cc.

Figure 2A:
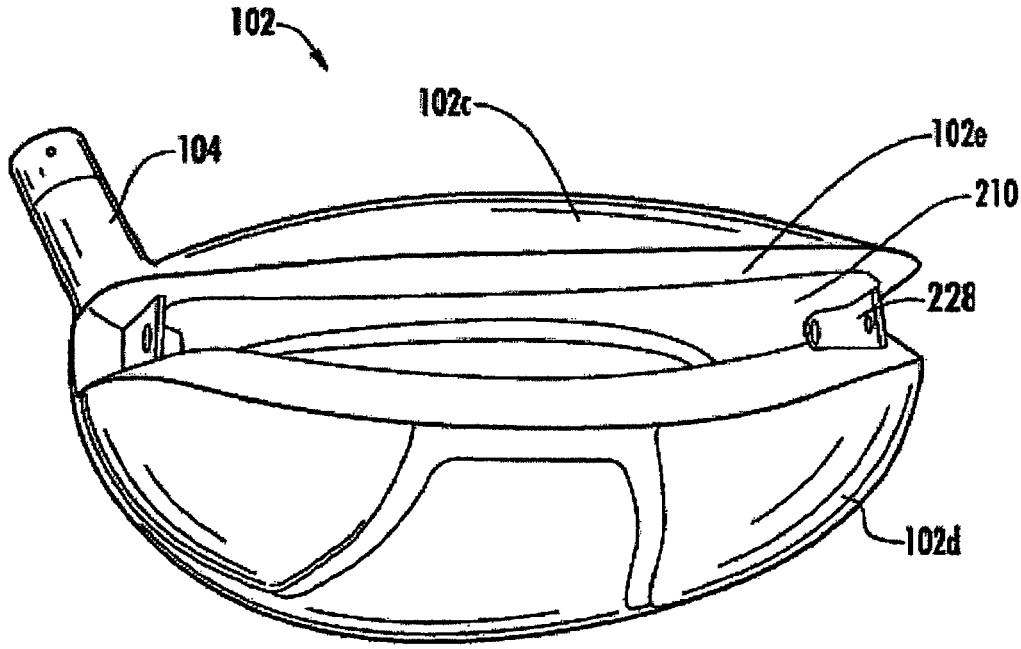
FIGS. 2A through 2C illustrate example golf club head structures that may be used in accordance with at least some examples of this invention.
Figure 2B:
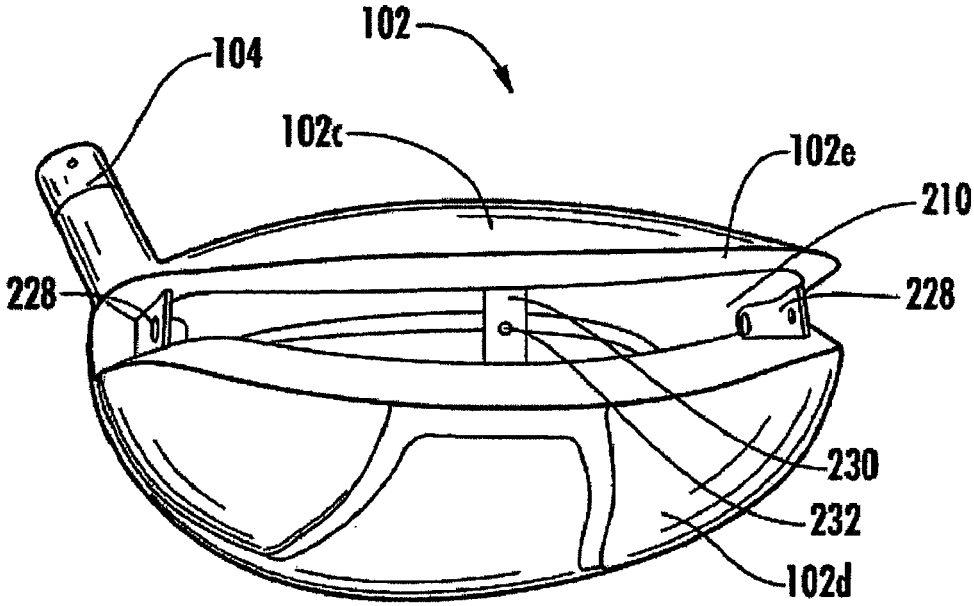
Figure 2C:
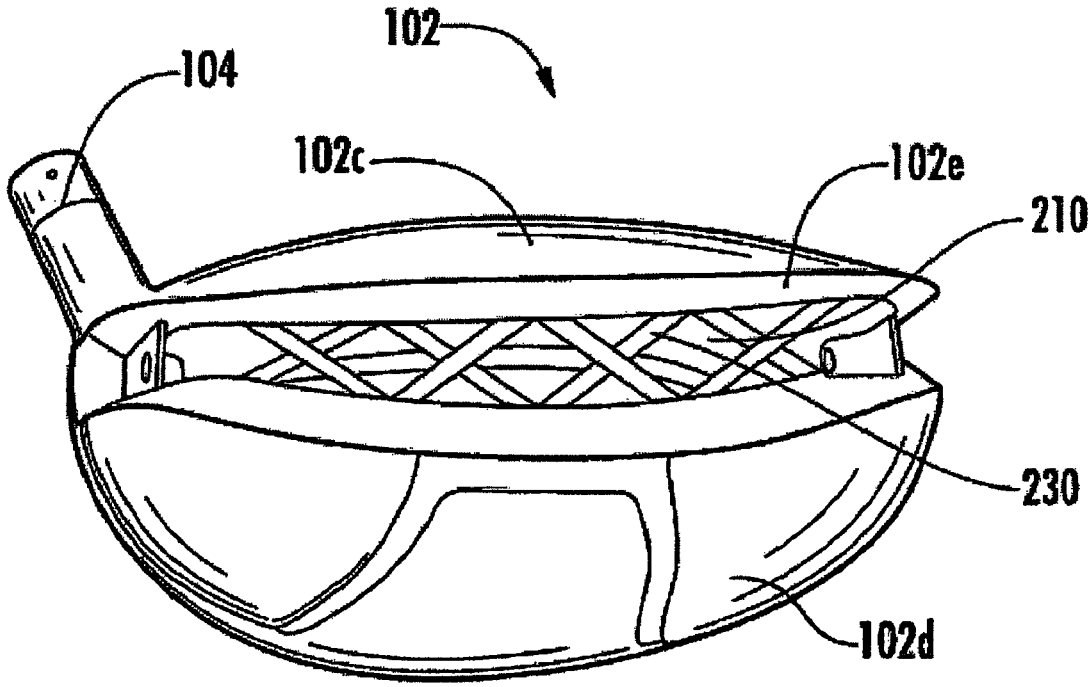

FIGS. 2A through 2C illustrate additional example features and structures that may be included in golf club 100 and golf club head 102 structures in accordance with this invention. As shown in these figures, the rear portion 102*e* of this club head structure 102 includes an opening 210 to the interior cavity of the hollow club head 102 structure. In certain embodiments, the opening 210 may extend into a portion of the crown 102*c* and/or a portion of the sole 102*d* and/or the opening 210 may extend into the heel and/or toe portions of the club head structure 102. The opening 210 may be of any desired shape and or size, e.g., depending upon the desired characteristics of the club head 102 structure and placement of the rear body member (which will be described in more detail below); the size, dimensions and shape of the opening(s) may not necessarily be defined by the size, dimensions or shape of the cavity. For example, in some embodiments, the opening(s) may extend at least 10% of the perimeter of the length of the cavity, at least 25% of the perimeter of the length of the cavity, at least 50% of the perimeter of the length of the cavity, or even 100% of the perimeter of the length of the cavity. Similarly, in some embodiments, the opening(s) may extend at least 10% of the perimeter of the width of the cavity, at least 25% of the perimeter of the width of the cavity, at least 50% of the perimeter of the width of the cavity, or even 100% of the perimeter of the width of the cavity.

The savings in weight of the club head 102 structure by having a cavity and/or opening 210 may provide certain advantages for modifying club head characteristics. Some advantages may include the ability to use the weight savings to distribute additional weight at selected other locations in the club head 102 structure and the ability to visually access and inspect the interior of the club head 102. In some embodiments, strategic placement of weight in certain locations on the rear body (or other locations in the club structure) may be used to bias the club to launch balls with a preselected flight trajectory, such as a fading flight pattern, a drawing flight pattern, a higher trajectory flight pattern, a lower trajectory flight pattern, etc.

In alternative embodiments, as shown in FIGS. 2B and 2C, the cavity may include one or more support beams 230 or struts extending across the opening to the interior cavity of the club head. These beams 230 may provide additional support for the rear or crown of the club and/or provide additional or alternative mounting locations for mounting the rear body member to the remainder of the club head 102 structure. As seen in one embodiment depicted in FIG. 2B, the club head 102 may include a substantially vertical beam 230 having a threaded opening 232 to receive a threaded connector (e.g., a screw or bolt) that may secure the rear body member to the remainder of the club head 102. Another embodiment, depicted in FIG. 2C, may include plural diagonally arranged beams 230 that may extend across the cavity providing a lattice or web construction appearance. Other arrangements of beams 230 are possible without departing from this invention.

While FIGS. 2A through 2C illustrate the opening to the interior cavity of the club head in the center of club head 102 rear face 102*e*, if desired, the opening to the interior cavity may be offset, e.g., located more toward the heel side or the toe side, and/or plural openings (e.g., one in the heel area and one in the toe area) to the interior cavity may be provided on a club head 102 structure without departing from this invention. The opening to the interior cavity also may be angled along the rear face 102*e* (e.g., in a direction from the front heel toward the rear toe, in a direction from the front toe toward the rear heel, etc.) without departing from this invention.

Figure 3A:
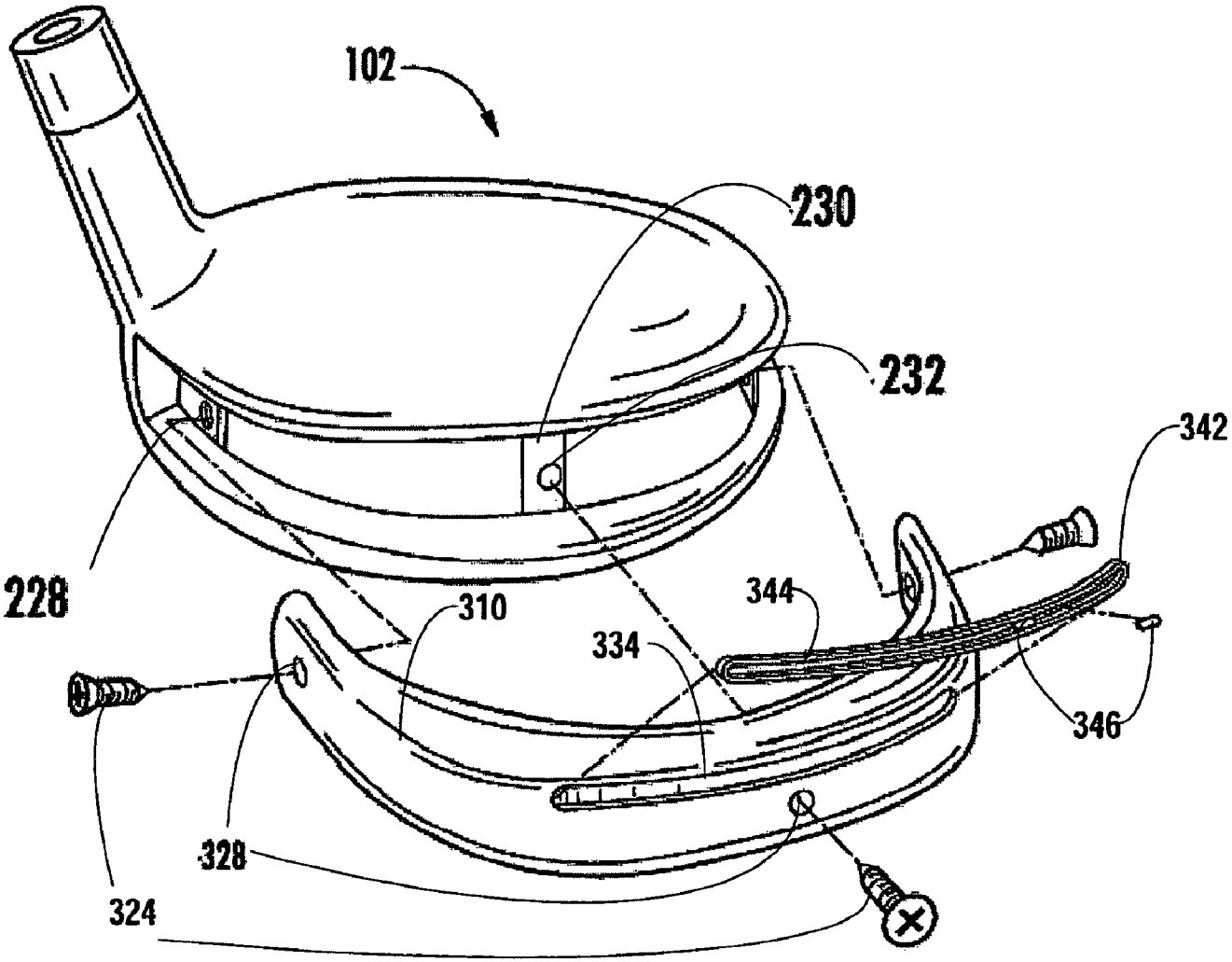
FIGS. 3A through 3C illustrate example rear body members that may be used in accordance with at least some examples of this invention.
Figure 3B:
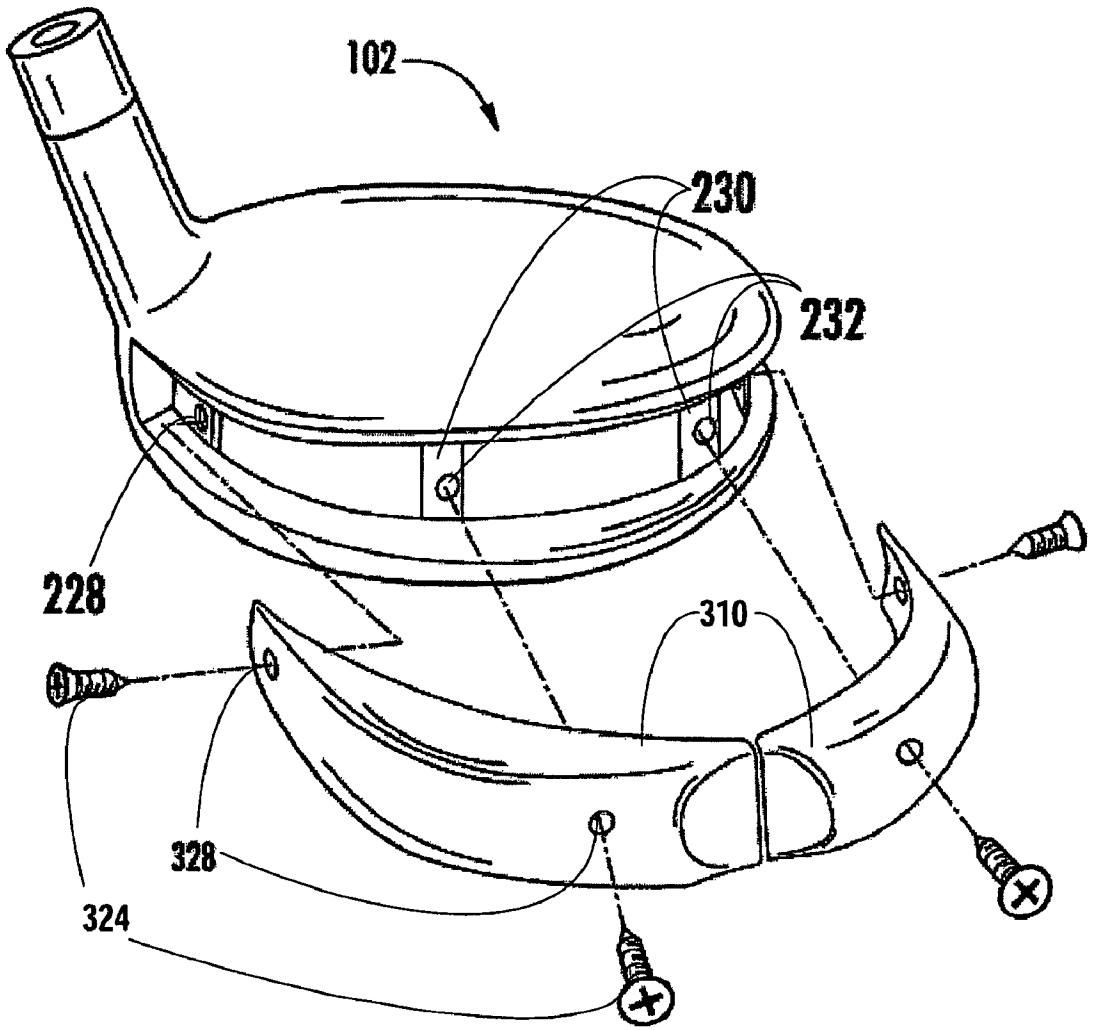
Figure 3C:
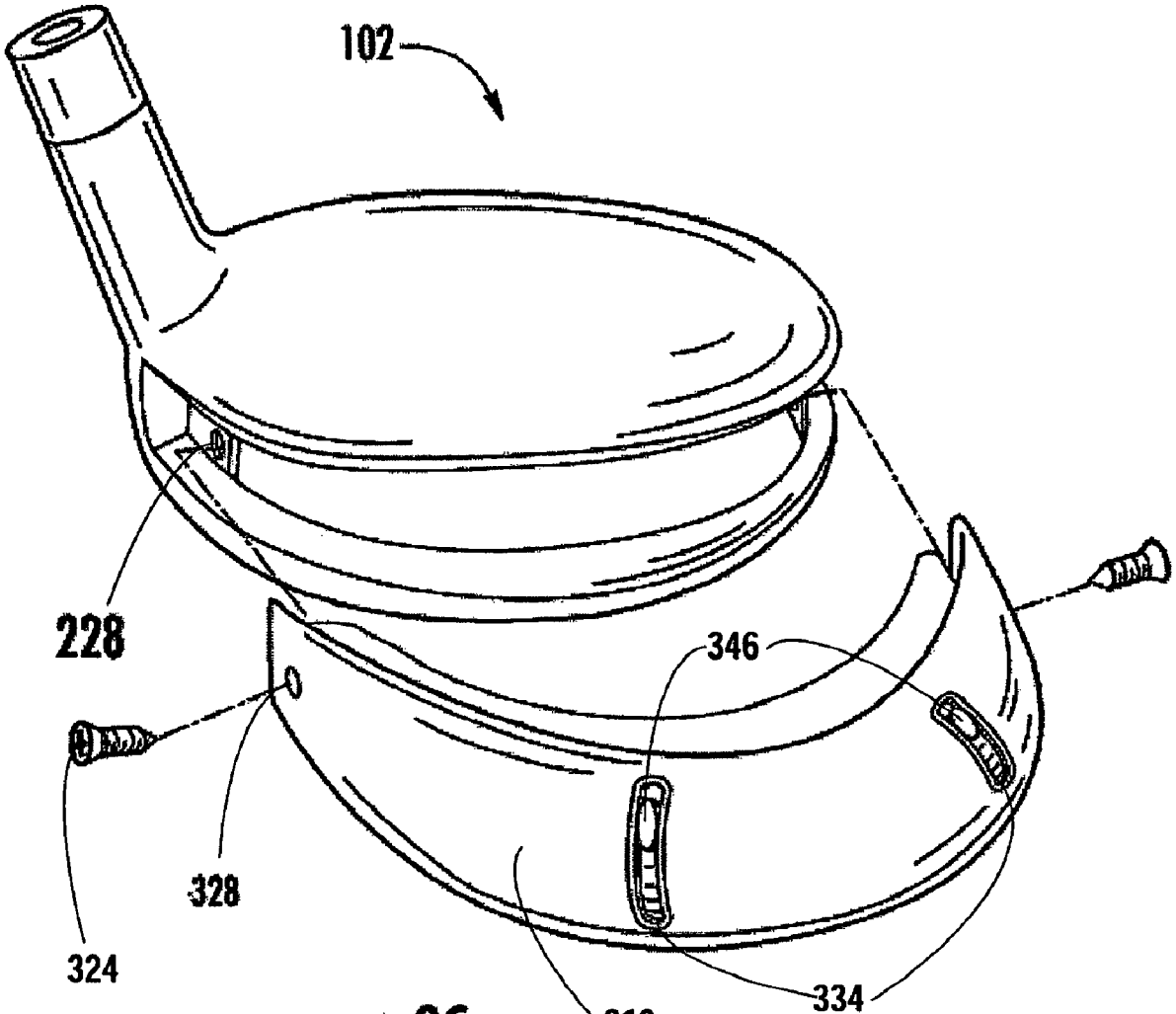

FIGS. 3A through 3C illustrate embodiments of a rear body member 310 in accordance with this invention and/or various portions thereof (including an example construction of such a club head 102). The rear body member 310 may be secured to the remainder of the club head 102 structure in a variety of ways. In the illustrated examples, one or more screw or bolt members 324 are provided to secure the rear body member 310 to the remainder of the club head 102 structure. Mounting holes 328 (optionally threaded) are defined on the rear body member 310 in this illustrated example, and screw or bolt members 324 may be arranged to engage holes 228 in the remainder of the club head 102 structure (optionally threaded) through these holes 328 to thereby hold the rear body member 310 in place with respect to the remainder of the club head 102 structure. If desired, the exposed head of screw or bolt member 324 may fit into a countersink opening provided in the rear body member 310 so that the screw or bolt member head does not extend beyond the surface of rear body member 310. Of course, any number of screw or bolt attachment holes 228 and 328 may be provided in the remainder of the club head 102 structure and the rear body member 310 without departing from this invention. If desired, cover members (such as friction fitted plugs, flaps, etc.) may be provided (not shown) to cover any exposed or open hole or holes that may receive the screw members (or other connectors) to present a solid construction appearance and to prevent dirt or debris from entering the holes and/or the club head body interior during use. In alternative embodiments, the screw or bolt members 324 may engage the holes 328 of the rear body member 310 through the holes 228 of the remainder of the club head 102 structure. In such embodiments, the countersink openings and/or cover members may then be a feature of the remainder of the club head 102 structure instead of the rear body member 310.

A wide variety of other ways of securing the rear body member 310 in place with respect to the remainder of the club head 102 structure are possible without departing from this invention. For example, if desired, the remainder of the club head 102 structure and/or the rear body member 310 may be provided with extending surfaces (such as detent mechanisms, spring mounted projections, ridges, etc.) that fit into corresponding and/or mating openings, slots, grooves, or the like provided in the other member. Any way of securing and releasing the rear body member 310 to the remainder of the club head 102 structure may be used without departing from this invention, including, for example: friction fits, clamps, clasps, mechanical connectors, cam structures, retaining member/groove or opening structures, spring loaded mechanisms, etc.

As illustrated in FIG. 3B, the rear body member 310 may optionally include more than one portion. The embodiment depicted shows a rear body member 310 that has two separate portions, but any number of portions may be used without departing from the scope of this invention. As previously stated, the opening to the cavity in which the rear body members are mounted may also be made up of a plurality of openings. Although some embodiments may have a one-to-one correlation of the number openings to the number of rear body member 310 portions, other embodiments may have fewer openings than rear body member 310 portions, while still other embodiments may have fewer rear body member 310 portions than openings. For example, in FIG. 3B, the opening to the cavity may comprise a single opening (separated into three portions by two support beams 230) while receiving a rear body member 310 comprising two separate portions (that optionally at least partially overlap one another, e.g., at the rear center of the club head). The ability to use varying numbers of openings and portions of rear body members 310 is advantageous in the flexibility provided for distributing weight differently according to desired golf club 100 characteristics.

Distributing weight at different places by using a rear body member 310 may allow users or club fitters to affect the flight of balls propelled using club heads 102 and golf clubs 100 in accordance with these examples of the invention. For example, it is typically easier for at least some users to get a golf ball airborne using a club head 102 having significant weight located lower and toward its rear (e.g., a rear body member 310 with the majority of its weight extending beyond the back of the club head 102 and toward the sole 102*d*). Such weight positioning also may be used to provide a higher, more lofted golf ball flight path, at least for some users. Under some play conditions and/or for some swing types, however, this higher flight bias and/or ball flight path may not be desirable. For example, to produce lower, more boring ball flights, e.g., for play in windy conditions, or for swing flaws that typically produce an excessively high, ballooning ball flight, a rear body member 310 may include a portion that extends into the interior cavity of the club head 102, such that more weight is positioned forward, toward the ball striking face.

In another possible embodiment of the invention, the surface of the rear body member 310 that is adjacent to or inserted into the rear body member receiving cavity of the club head 102 may include mating portions (e.g., projections and/or receptacles therefore) that, when the rear body member 310 is secured to the remainder of the club head 102 structure, may extend into openings located between and/or in the beams 230. Alternatively, or in addition, the rear body member 310 and/or the remainder of the club head 102 structure may include mating portions (male and/or female), which may help to securely hold the rear body member(s) 310 in place within the rear body member receiving cavity of the club head 102.

FIGS. 3A and 3C illustrate another feature provided in club head 102 structures according to at least some examples of this invention. Notably, in these example structures, the rear body member 310 or some other portion of the club head 102 structure may include a slot, groove, or opening 334 defined therein. This slot, groove, or opening 334 may be used for mounting a weight member 346, examples of which will be described in more detail below. The slot, groove, or opening 334 may be open, partially open or closed without departing from this invention.

The slot, groove, or opening 334 may take on any desired size or shape, and it may be provided at any desired position or location in the club head structure (e.g., in the sole 102*d*, in the crown 102*c*, in the rear face 102*e*, in the rear body member 310, etc.) without departing from this invention. Also, if desired, the club head 102 structure, including any individual part thereof (e.g., the rear body member 310, the sole 102*d*, etc.), may include more than one slot, groove, or opening 334 for receiving weight members 346. Also, any number of separate and individual weight members 346 may be mounted in the various slots, grooves, or openings 334 without departing from this invention (e.g., one slot, groove, or opening 334 may include any desired number of weight members 346, including zero, one, two, or more). In the example structure illustrated in FIG. 3A, the rear body member 310 includes a single slot, groove, or opening 334 that extends from the across the width of the rear body member 310. In the example structure illustrated in FIG. 3C, the rear body member 310 includes two horizontally arranged openings 334. Additionally or alternatively, a similar slot, groove, or opening 334 may be provided at different locations in the rear body member 310 or elsewhere in the remainder of the club head 102 structure. As yet another alternative, if desired, some portion of the club head (e.g., the sole 102*d*, the rear face 102*e*, etc.) may include one or more weight ports in which one or more removable weight members 346 may be mounted (optionally, in a tight fitting or non-slidable manner). Such constructions enable users (or club fitters) to provide additional weight in different portion(s) of an overall club head 102 structure, which can be useful to provide a draw biased club, a fade biased club, and/or a club that helps compensate for swing flaws that typically produce an excessively fading or slicing ball flight or a drawing or hooking ball flight.

If desired, one or more weight members 346 may be directly engaged with the slot, groove, or opening 334 of the club head 102 structure as shown in the example illustrated in FIG. 3C. The weight member(s) 346 may be held in place in any desired manner, including in a releasable or removable manner, permanently mounted therein, etc., including through the use of mechanical connectors (e.g., screws, bolts, spring-loaded retaining elements, detents, friction fits, etc.), fusing techniques (e.g., adhesives, cements, welding, brazing, soldering, etc.), and the like. FIG. 3A, however, illustrates another possible construction that may be used in accordance with at least some examples of this invention. As shown in this example structure, a weight cartridge member 342 is mounted in the slot, groove, or opening 334 of the rear body member 310. The weight cartridge member 342 may be designed to fit flush with the remainder of the surface of the rear body member 310, extend somewhat out from the rear body member 310, or, if desired, countersunk into the rear body member 310. The weight cartridge member 342 may be made from any desired materials, including, for example, metal alloy materials, polymeric materials, etc. (e.g., any of the materials used in constructing the golf club head 102, as described above, any other material typically used in golf club construction, etc.). The weight cartridge member 342 may be secured to the rear body member 310 (and/or other portion of the club head 102 structure) in any desired manner, such as through the use of mechanical connectors, fusing techniques, or the like.

The weight cartridge member 342 of this example structure in FIG. 3A includes an open channel 344 into which one or more weight members 346 may be mounted. The weight member(s) 346 may be mounted in the channel 344 in any desired manner without departing from this invention, including using mechanical connectors (e.g., screws, turnbuckles, etc.), spring-loaded mechanisms (e.g., detents, spring-biased retaining elements fitting into openings in the channel 344 wall, etc.), other retaining members and/or retaining groove structures, and the like. Also, the channel 344 and/or weight member(s) 346 may be provided with structures so as to allow mounting at plural, discrete positions along the channel 344, or the securing mechanisms may allow mounting at any desired position(s) along the channel without departing from this invention (e.g., using various securing, locking, or anchoring structures). The weight members 346 may be made from lead, tungsten, lead-containing materials, tungsten-containing materials, and/or other heavy or dense materials. The weight members 346 may be made of other materials as well.

The weight cartridge member 342 may be secured with the rear body member 310 at any desired time in the club head manufacturing process without departing from this invention. In some embodiments, the weight cartridge member 342 is attached to the rear body member 310 before the rear body member 310 is attached to the remainder of the golf club head 102 structure. Other construction techniques are possible, such as attachment of the weight cartridge member 342 to the rear body member 310 after the rear body member 310 is engaged with the remainder of the club head 102 structure. Also, if desired, the weight cartridge member 342 need not be secured only to the rear body member 310. Also, the weight cartridge member 342 may be provided in other portions of the club head 102 structure, such as in the crown 102*c* and/or the sole 102*d*, and optionally not in the rear body member 310, without departing from this invention. Any number of weight cartridge members 342, at any desired locations in an overall club head 102 structure, may be used without departing from this invention.

While various structures and techniques are described above (e.g., rear body members 310 with different weight distributions mounted to the remainder of the club head 102 structure in various ways) in conjunction with various specific structures shown in FIGS. 1A through 3C, features and aspects of this invention may be applied to a wide variety of club head structures or constructions without departing from the invention. For example, a wide variety of constructions, numbers of parts, combinations of materials, and the like may be used, including constructions, parts, and combinations of materials that are known and used in the art. More specific examples of additional potential club head constructions that may include weight attaching structures and/or weighting techniques of the types described above include, but are not limited to: two piece club constructions, e.g., of metallic or metal alloy materials, polymer-containing materials, or composite-containing materials, either as a solid material or a having a hollow interior chamber within the club head, including a main body and a separable rear body member; constructions having a face member (e.g., a face frame member with a face plate attached thereto or integrally formed therewith) with an aft body attached thereto (the aft body may be constructed from one or more of metallic or metal alloy materials, polymer-containing materials, or composite-containing materials, either as a solid material or a having a hollowed out interior chamber) and a rear body member attached to the aft body; multi-piece constructions, e.g., constructions having a face member (e.g., a face frame member with a face plate attached thereto or integrally formed therewith) with a multi-piece body attached thereto (the body may be constructed from one or more of metallic or metal alloy materials, polymer-containing materials, or composite-containing materials, e.g., including one or more of a crown member, a sole member, one or more body members, etc) including a rear body member; etc. A wide variety of other constructions also are possible.

Weight adjustable golf club heads of the types described above may be used by golfers, on the golf course, for their regular play (users can maintain the ability to modify the weight settings and/or customize the club head to their swing characteristics). As another example, however, golf club heads in accordance with at least some examples of this invention (e.g., of the types described above) also may be useful for club fitting purposes. For example, by providing club heads with different rear body members of the types described above, club fitters and/or users can quickly adjust the playing characteristics of a club head by adjusting or interchanging the rear body members used and/or provided with the club head. In this manner, a user being fit for new clubs and/or club components can quickly try different weighting characteristics for the club head using a single club head (as opposed to the club fitter having to carry a large inventory of club heads each with slightly different weighting characteristics). Then, when a weight arrangement and/or orientation is found that best suits a user's swing characteristics and/or provides a desired ball flight path, based on the adjustable club head's settings (e.g., the position and amount of the weight within the rear body member that produces the best characteristics for that user), the club fitter can order or build a club head for the user having permanent weighting characteristics based on and derived from the club head construction and removable rear body member used during the fitting session(s).

III. CONCLUSION

The present invention is described above and in the accompanying drawings with reference to a variety of example structures, features, elements, and combinations of structures, features, and elements. The purpose served by the disclosure, however, is to provide examples of the various features and concepts related to the invention, not to limit the scope of the invention. One skilled in the relevant art will recognize that numerous variations and modifications may be made to the embodiments described above without departing from the scope of the present invention, as defined by the appended claims. For example, the various features and concepts described above in conjunction with FIGS. 1A through 3E may be used individually and/or in any combination or subcombination without departing from this invention.

We claim:

1. A golf club head comprising:

a club head body made from one or more parts, wherein the club head body includes a heel portion, a toe portion, a top portion, a sole portion, a striking face, and a rear portion opposite the striking face, wherein the club head body defines an interior cavity, and wherein the rear portion defines at least a first opening to the interior cavity; and a rear body, wherein the rear body is releasably engaged with the club head body and is configured to at least partially cover the first opening, wherein the rear body includes a first rear body member and a second rear body member and wherein the first rear body member at least partially covers the first opening and the second rear body member at least partially covers a second opening to the interior cavity defined in the rear portion of the club head body; and wherein the first opening is elongated in a heel to toe direction of the club head body.

2. The golf club head of claim 1, wherein the rear portion of the club head body includes a beam, and wherein the beam separates the first opening from the second opening to the interior cavity.

3. The golf club head of claim 2, wherein the beam is substantially vertical and is located at a central area of the rear portion of the club head body.

4. The golf club head of claim 2, wherein the beam defines a beam opening, and wherein the rear body includes a projection structured and arranged to extend into the beam opening.

5. The golf club head of claim 1, wherein the first rear body member is comprised of a first material and the second rear body member is comprised of a second material that differs from the first material.

6. The golf club head of claim 1, wherein the first rear body member has different weighting characteristics than the second rear body member.

7. The golf club head of claim 1, wherein the first rear body member has a different weight distribution than the second rear body member.

8. The golf club head of claim 1, wherein the rear body is configured to give the golf club head an overall square-shaped appearance.

9. The golf club head of claim 1, wherein the rear body includes at least one receptacle configured to receive a weight.

10. The golf club head of claim 1, wherein the rear body includes a cover configured to make the golf club head appear not to have removable parts.

11. The golf club head of claim 1, wherein the rear body is configured to give the golf club head a rounded rear perimeter shape.

12. The golf club head of claim 1, wherein the rear body is releasably engaged with the club head body via one or more threaded connectors.

13. A golf club head comprising:

a club head body made from one or more parts, wherein the club head body includes a heel portion, a toe portion, a top portion, a sole portion, a striking face, and a rear portion opposite the striking face, wherein the club head body defines an interior cavity, and wherein the rear portion defines at least a first opening to the interior cavity; and a rear body, wherein the rear body is releasably engaged with the club head body and is configured to at least partially cover the first opening, wherein the rear body includes a first rear body member and a second rear body member and wherein the first rear body member is a different size than the second rear body member, wherein the first rear body member at least partially covers the first opening and the second rear body member at least partially covers the first opening.

14. A golf club head, comprising:

a club head body made from one or more parts, wherein the club head body includes a heel portion, a toe portion, a top portion, a sole portion, a striking face, and a rear portion opposite the striking face, wherein the club head body defines an interior cavity, and wherein the rear portion defines at least a first opening to the interior cavity; and a rear body made from one or more parts, wherein the rear body is releasably engaged with the club head body and is configured to at least partially cover the first opening, wherein the rear portion of the club head body includes a plurality of beams, and wherein the rear portion of the club head body defines a plurality of openings to the interior cavity at locations between the plurality of beams.

15. The golf club head of claim 14, wherein the plurality of beams extend diagonally along the rear portion of the club head body.

16. A method for assembling a golf club head comprising:

providing a club head body made from one or more parts, wherein the club head body includes: a heel portion, a toe portion, a top portion, a sole portion, a striking face, and a rear portion opposite the striking face, wherein the club head body defines an interior cavity, and wherein the rear portion defines at least a first opening to the interior cavity;

releasably securing a first rear body to the club head body, wherein the first rear body is made from one or more parts and is configured to at least partially cover the first opening, removing the first rear body from the club head body; and releasably securing a second rear body to the club head body, wherein the second rear body is made from one or more parts and is configured to at least partially cover the first opening and wherein the first rear body is a different size than the second rear body, wherein the rear portion of the club head body includes a beam, wherein the beam separates the first opening from a second opening to the interior cavity.

17. The method of claim 16, wherein the beam is substantially vertical and is located at a central area of the rear portion of the club head body.

18. The method of claim 16, wherein the beam defines a beam opening and the rear body includes a projection, and wherein the step of releasably securing includes placing the projection into the beam opening.

19. A golf club head kit, comprising:

a club head body made from one or more parts, wherein the club head body includes a heel portion, a toe portion, a top portion, a sole portion, a striking face, and a rear portion opposite the striking face, wherein the club head body defines an interior cavity, and wherein the rear portion defines at least a first opening to the interior cavity;

a first rear body made from one or more parts, wherein the first rear body is releasably engageable with the club head body and is configured to at least partially cover the first opening; and a second rear body made from one or more parts, wherein the second rear body is releasably engageable with the club head body and is configured to at least partially cover the first opening, wherein the first rear body has a different shape than the second rear body, wherein the rear portion of the club head body includes a beam, wherein the beam separates the first opening from a second opening to the interior cavity.

* * * * *